US007380667B2

(12) United States Patent
Divine

(10) Patent No.: US 7,380,667 B2
(45) Date of Patent: Jun. 3, 2008

(54) NEWSPAPER BAGGER SYSTEM

(76) Inventor: Kenneth D. Divine, 13584 Patricie St., Red Bluff, CA (US) 96080

( * ) Notice: Subject to any disclaimer, the term of this patent is extended or adjusted under 35 U.S.C. 154(b) by 0 days.

(21) Appl. No.: 11/335,048

(22) Filed: Jan. 19, 2006

(65) Prior Publication Data

US 2007/0163211 A1 Jul. 19, 2007

(51) Int. Cl.

| | |
|---|---|
| ***B65D 33/00*** | (2006.01) |
| ***B65D 85/62*** | (2006.01) |
| ***B65D 83/08*** | (2006.01) |
| ***B65B 43/14*** | (2006.01) |

(52) U.S. Cl. ..... 206/554; 53/572; 248/95

(58) Field of Classification Search ..... 53/572; 206/554; 248/95; 221/26, 45, 46, 63
See application file for complete search history.

(56) References Cited

U.S. PATENT DOCUMENTS 3,144,960 A * 8/1964 Membrino ..... 221/26
3,190,490 A * 6/1965 Membrino ..... 221/26
3,285,406 A * 11/1966 Winesett ..... 206/554
4,527,693 A * 7/1985 Membrino ..... 206/554
5,184,728 A * 2/1993 Wile ..... 206/554

* cited by examiner

*Primary Examiner*—Stephen F Gerrity
(74) *Attorney, Agent, or Firm*—Timothy M. Barlow

(57) ABSTRACT

A newspaper bagger system includes a bag support and a bag chute suspended around and from the bag support. The bag support includes a plurality of detachable bags that extend through the bottom of the chute. The bag chute includes a shoulder at an upper end of the chute to hang the bag chute from the bag support and can also include a vertical slot on a front side of the chute that extends down from the upper end of the chute about half the length of the chute. An upper stiffener is incorporated into the back of the chute and across the shoulder section of the chute and a lower stiffener is attached outside the chute and adjacent to a bottom of the chute. The bagger system is suspended from the interior of an automobile.

9 Claims, 4 Drawing Sheets

NEWSPAPER BAGGER SYSTEM

FIELD OF THE INVENTION

This invention relates generally to the field of loading chutes, and more specifically to a newspaper bagger for delivery persons and others.

BACKGROUND OF THE INVENTION

Newspapers and other publications must be bagged before delivery for many reasons. Snow, rain, advertisements and sales fliers are just some of the reasons. The delivery person is faced with the daunting task of bagging these newspapers, sometimes on a daily basis. Many times, the bagging needs to be accomplished before the delivery person can even start his delivery route. It is very difficult to bag the newspapers en route.

For those delivering from a bicycle or on foot, not much can be done to avoid bagging the papers before delivery. Without a protective cover, the unprotected newspapers would soon be destroyed. There is simply no room to carry the empty bags or the specialized equipment necessary to bag the newspapers while delivering. He must bag the newspapers before starting to deliver them.

Typically, the delivery person has a stack of bags that are attached to a header. The person must guide each paper into each bag carefully, so that the paper does not unroll and spring out of the bag.

Automobile-based newspaper delivery persons have an advantage, in that they have an enclosed space, the car, to protect the unbagged newspapers while en route, however in many cases, the papers still need to be bagged before delivery.

Thus, what is needed is an easy to use, inexpensive system and method for bagging newspapers for delivery.

It is intended that any other advantages and objects of the present invention that become apparent or obvious from the detailed description or illustrations contained herein are within the scope of the present invention.

SUMMARY OF THE INVENTION

The device is a newspaper bagger system and method that includes a bag support and a bag chute suspended around and from the bag support. The bag support includes a plurality of detachable bags that extend through the bottom of the chute. The bag chute includes a shoulder at an upper end of the chute to hang the bag chute from the bag support and can also include a vertical slot on a front side of the chute that extends down from the upper end of the chute about half the length of the chute. An upper stiffener is incorporated into the back of the chute and across the shoulder section of the chute and a lower stiffener is attached outside the chute and adjacent to a bottom of the chute. The bagger system is suspended from any convenient location, such as the interior of an automobile.

The guide chute is hung around a bag support having a plurality of detachable bags, and the bag support is hung in a stationary position, such as an automobile interior. The user rolls a newspaper and opens the mouth of the first bag. The first bag is typically the top bag in the plurality of bags. The rolled newspaper is inserted into the first bag's mouth and guided through the mouth of the first bag and into the guide chute. The newspaper is then dropped into the chute, and it falls to the bottom of the first bag. The first bag and rolled newspaper are then removed from the plurality of detachable bags.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

Figure 1:
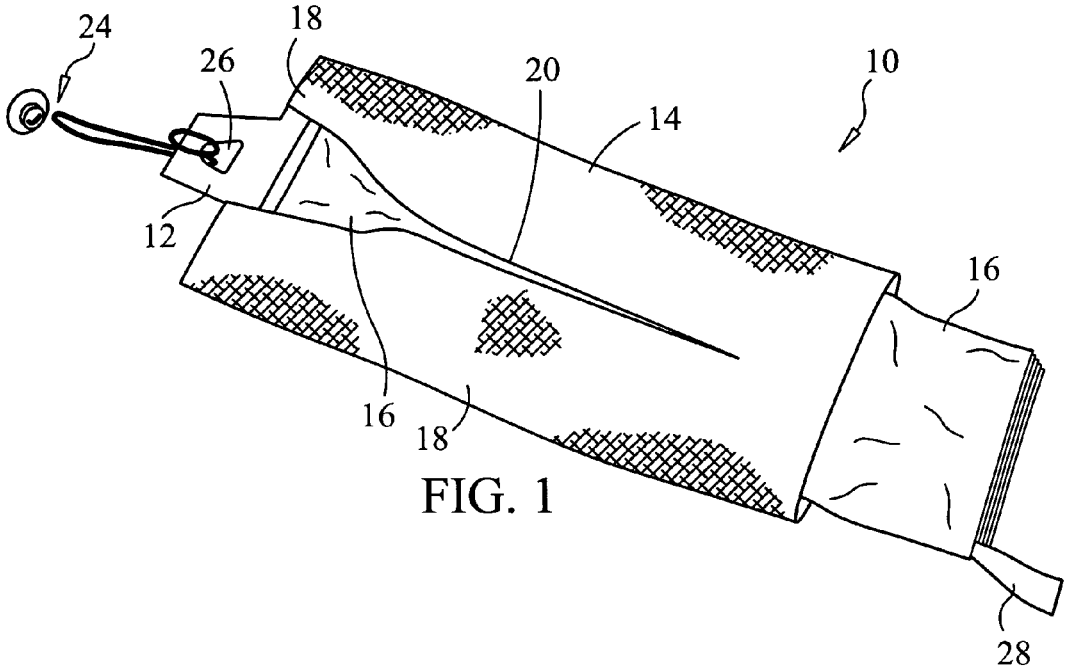
FIG. 1. is a front perspective view of a newspaper bagger system, according to the present invention.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DETAILED DESCRIPTION OF THE INVENTION

The following detailed description is of the best presently contemplated modes of carrying out the invention. This description is not to be taken in a limiting sense, but is made merely for the purpose of illustrating general principles of embodiments of the invention.

Referring now to the drawings, the attached figures illustrate a newspaper bagger system for automotive use or bagging locations.

Figure 2:
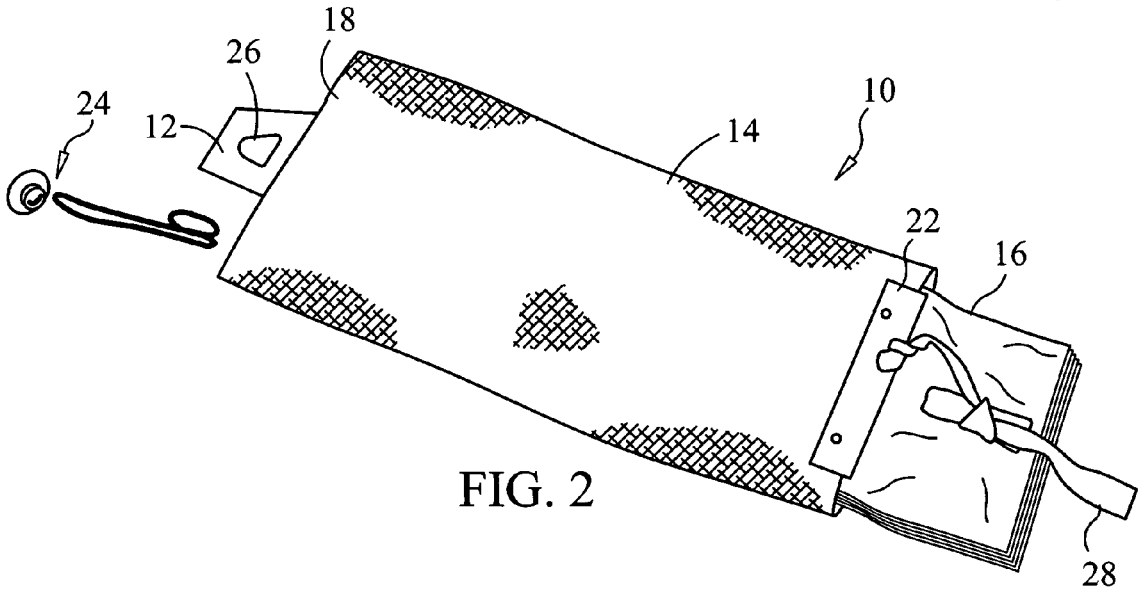
FIG. 2. is a rear perspective view of the newspaper bagger system, according to the present invention.

FIGS. 1 and 2 show a newspaper bagger system 10 that includes a bag support 12 and a bag chute 14 suspended around and from the bag support 12. The bag support 12 includes a plurality of detachable bags 16 attached to the bag support 12. The bag support 12 is a cardboard header that includes a loop and a horizontal portion to which the bags 16 are attached. The bags 16 are stacked against the bag support 12 and generally include a perforated section that is attached to the horizontal section of the bag support 12. The opening of each of the plurality of bags 16 is adjacent to the perforated section. Each of the plurality of bags 16 is easily removed from the bag support 12.

The bag chute 14 comprises a shoulder 18 at an upper end of the chute 14. The shoulder 18 supports the bag chute 14 from the horizontal portion of the bag support 12. When assembled, the bottom of each of the bags 16 extends through the bottom of the chute 14. The bag chute 14 includes a vertical slot 20 on the front side of the chute 14 that extends down from the upper end of the chute 14. The length of the slot 20 may vary depending upon the size of the object to be bagged, the rigidity of the chute 14 and other factors. In some cases, the slot 20 may extend about half the length of the chute 14. In other cases, the slot 20 may extend most of the length of the chute 14. Thus, the chute resembles a vest, but without arm holes and with a slot 20, or placket, that is not completely open. In one embodiment, the slot 20 extends the length of the chute 14. The slot 20 can be adjustably closed or opened to load a plurality of bags 16 or to adjust the loading properties of the chute 14. The adjustability of the slot 20 can be via a zipper, hook and loop material, or similar means.

The chute 14 may include an upper stiffener (not shown) that is incorporated into the back of and across the shoulders 18 of the chute 14. The upper stiffener will be behind the horizontal section of the bag support 12. A lower stiffener 22 may also be used. The lower stiffener shown as attached to the outside, rear bottom of the chute 14. This prevents the lower stiffener 22 from catching the newspaper as it goes through the chute 14.

To aid in using the system 10, a suspension device 24 is removably attached to the bag support 12. Most bag supports 12 for newspaper use have a loop 26 incorporated into them. Thus, the bag support 12 and chute 14 can be supported from an automobile interior or other work area. A lower tie 28 permits the chute 14 to be secured to prevent or minimize swinging and movement.

Figure 3:
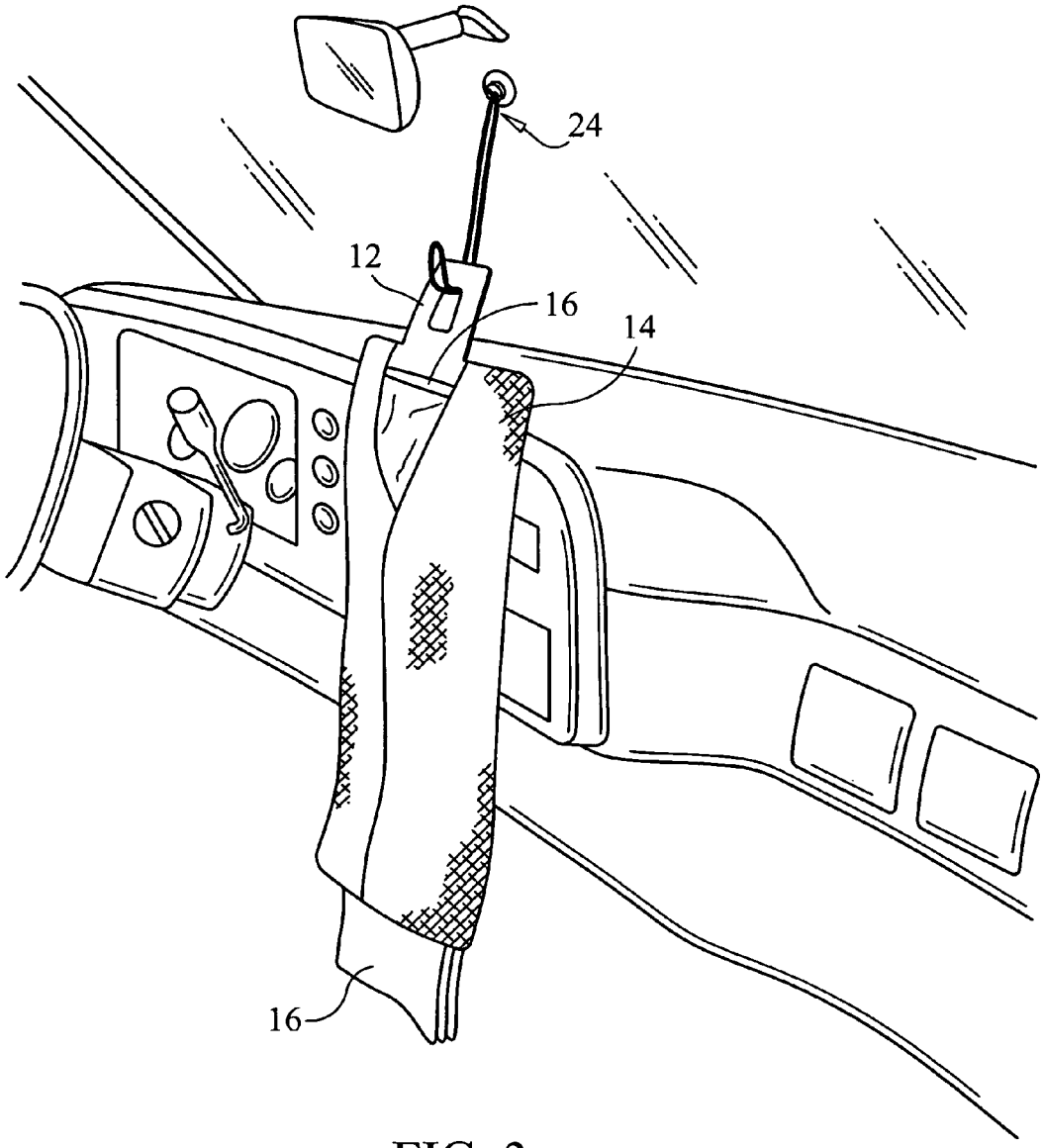
FIG. 3 is an environmental view of the newspaper bagger system, according to the present invention.
Figure 4:
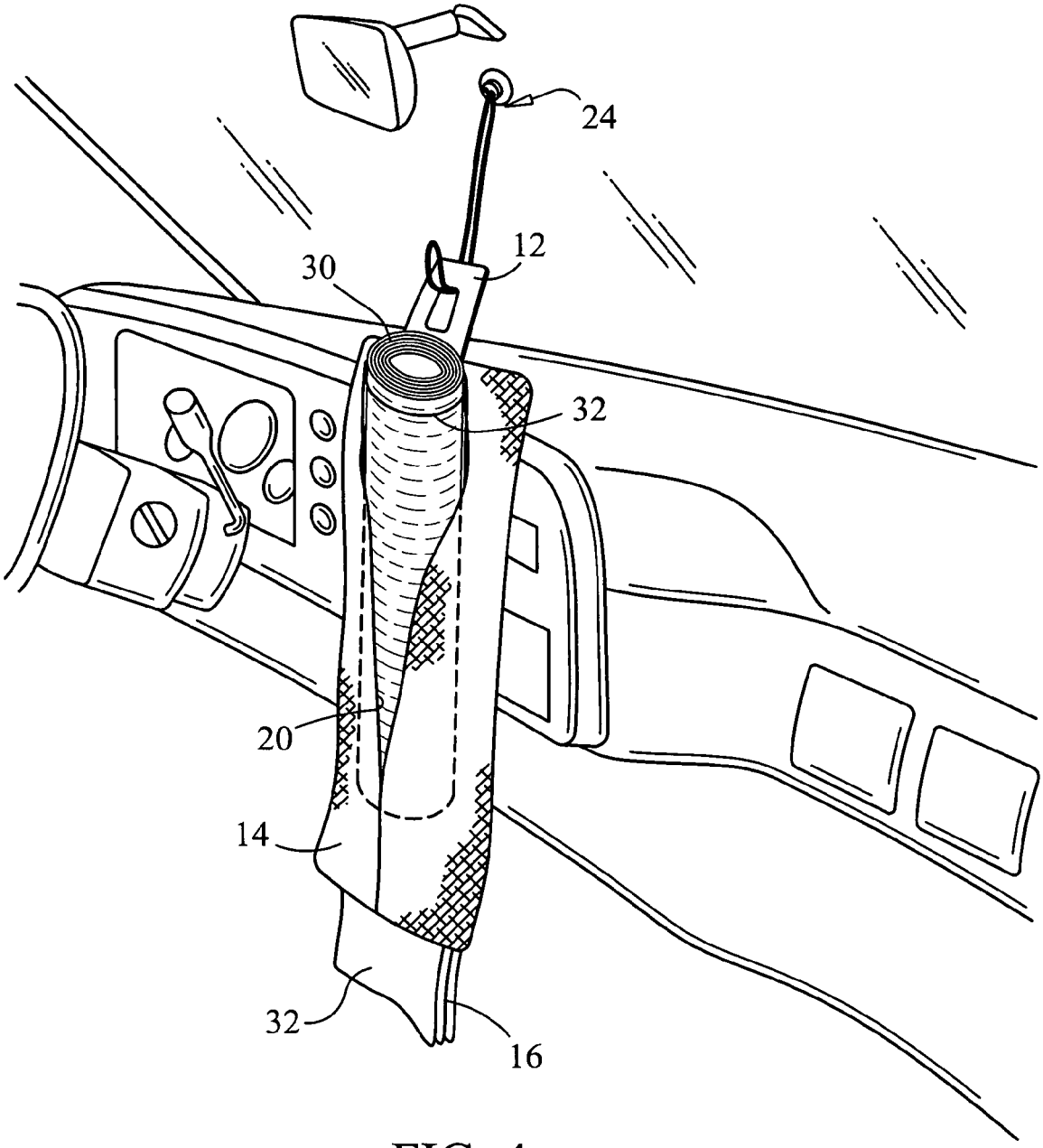
FIG. 4 is an environmental view of the newspaper bagger system, according to the present invention.
Figure 5:
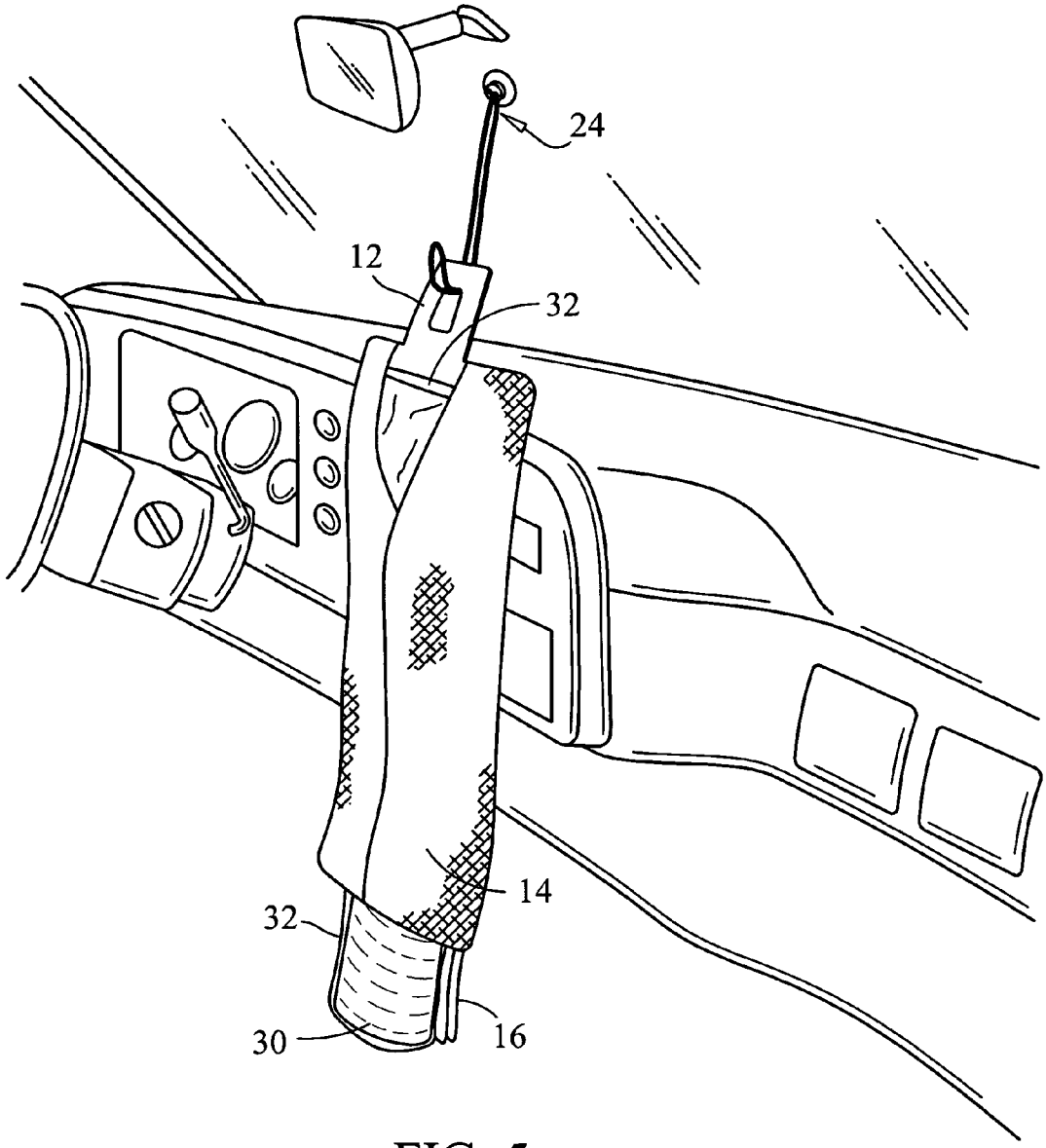
FIG. 5 is an environmental view of the newspaper bagger system, according to the present invention.

FIGS. 3-5 show the newspaper bagging system 10 in use. The first step is to hang the guide chute 14 around the bag support 12. The bag support 12 should have a plurality of detachable bags 16. The bag support 12 is hung in a stationary position with a suspension device 24. The suspension device 24 can be a hook for attaching to a wall or rearview mirror, or can include a suction cup for attachment to a windshield, as shown. Next, the user rolls a newspaper 30 and opens the mouth of the top bag 32 in the plurality of detachable bags 16. The opening of the top bag is easily accessible through the opening at the top of the chute 14. The user simply pulls the bag 32 open slightly so that he can insert the rolled newspaper 30 into the bag's mouth (see FIG. 4).

Next, the user guides the newspaper 30 through the mouth of the top bag 32 and into the guide chute 14. The chute 14 guides and supports the newspaper 30 so that the newspaper 30 goes smoothly into the bag 32 even if the bag 32 is a bit crooked as it is started. The slot 20 at the front of the chute 14 may open slightly to accommodate the size of the rolled newspaper 30, but the sides of the chute 14 around the slot 20 act to laterally support the newspaper 30 within the chute 14. The chute 14 is made from a heavy, flexible material that is easily manipulated to accommodate a newspaper 30, yet has enough support to guide the newspaper 30 into the chute 14.

As the newspaper 30 is supported by the chute 14, the user can release the newspaper 30 (see FIG. 5). With the support of the chute 14, the newspaper 30 will drop into the bottom of the top bag 32. The bagged newspaper 30 is now visible below the bottom of the chute 14. The user then removes the top bag 32 with the rolled newspaper 30 from the plurality of detachable bags. Removal is a simple task because each of the plurality of bags 16 is attached to the support 12 with a perforated strip. The user simply pulls the top bag 32 down and it cleanly separates from the support 12. The user is now holding a bagged newspaper 30 that is ready for delivery.

Reloading the system with new bags is quick and easy as well. The empty bag support 12 is removed from the suspension device 24. The support 12 is then pulled from the chute 14. A new bag support 12 with a new plurality of bags 16 is then drawn through the chute 14 from the bottom of the chute 14, so that the plurality of bags 16 is flat and extends from the bottom of the chute 14. The support 12 is then hung from the suspension device 24.

In an alternative embodiment, the chute includes a zipper or hook and loop material below, and an extension of, the slot 20. With this embodiment, bag support 12 can be hung upon the suspension device 24 immediately and the chute 14 is simply opened and attached around the bag support 12. The chute 14 is constructed in various sizes to accommodate several sizes of bags and widths of bag supports 12.

This system and method can be performed in a moving vehicle or any suitable stationary location to quickly and efficiently bag newspapers or other similar items. It does not interfere with a driver's view through the windshield or with the rearview mirror.

While the description above refers to particular embodiments of the present invention, it will be understood that many modifications may be made without departing from the spirit thereof. The accompanying claims are intended to cover such modifications as would fall within the true scope and spirit of the present invention.

I claim:

1. A bagger system comprising:

a bag support;

a flexible, tubular bag chute suspended around and from the bag support; and a plurality of detachable bags removably attached to the bag support, where the bags extend into and through the tubular bag chute, the bag chute including an upper chute opening adjacent a mouth of a first bag of the plurality of bags, a lower chute opening through which a bottom of the first bag extends; and a vertical slot on a front side of the chute, the vertical slot being in direct communication with the upper chute opening and extending down from the upper end of the chute about half the length of the chute.

2. The bagger system of claim 1, where the bag chute comprises a shoulder at an upper end of the chute adjacent the upper chute opening to hang the bag chute from the bag support.

3. The bagger system of claim 2, where the bag chute comprises a stiffener incorporated into a back of the chute and across the shoulder section of the chute.

4. The bagger system of claim 1, where the bag chute comprises a lower stiffener attached adjacent to a bottom of the chute.

5. The bagger system of claim 4, where the lower stiffener is attached outside the chute.

6. The bagger system of claim 1, where the bag support comprises a suspension device.

7. A bagger system comprising:

a bag support comprising a plurality of detachable bags; and a flexible, tubular bag chute suspended from and around the bag support, the chute comprising a shoulder at an upper end of the chute to hang the bag chute from the bag support, the plurality of bags arranged to extend through the tubular bag chute, the bag chute including an upper chute opening adjacent the shoulder and adjacent a mouth of a first bag of the plurality of bags;

a lower chute opening through which a bottom of the first bag extends; and a vertical slot on a front side of the chute, the slot extending down from the upper end of the chute about half the length of the chute, the vertical slot extending through the chute to the upper chute opening.

8. The bagger system of claim 7, where the bag chute further comprises an upper stiffener incorporated into a back of the chute and across the shoulder section of the chute, and a lower stiffener attached adjacent to a bottom of the chute.

9. The bagger system of claim 8, where the lower stiffener is attached outside the chute.

* * * * *